US008905810B2

(12) United States Patent
Muccini et al.

(10) Patent No.: US 8,905,810 B2
(45) Date of Patent: Dec. 9, 2014

(54) PLUSH WRITING TOY

(76) Inventors: Edward Joseph Muccini, Douglaston, NY (US); Robert Manca, Kings Park, NY (US)

( * ) Notice: Subject to any disclaimer, the term of this patent is extended or adjusted under 35 U.S.C. 154(b) by 432 days.

(21) Appl. No.: 12/766,540

(22) Filed: Apr. 23, 2010

(65) Prior Publication Data

US 2010/0273391 A1 Oct. 28, 2010

Related U.S. Application Data

(60) Provisional application No. 61/171,934, filed on Apr. 23, 2009.

(51) Int. Cl.
*A63H 33/00* (2006.01)
*A63H 3/00* (2006.01)
*A63H 3/14* (2006.01)

(52) U.S. Cl.
USPC ..... 446/26; 446/72; 446/327

(58) Field of Classification Search
CPC ..... A63H 3/02; A63H 3/14; A63H 33/00; A63H 33/004; A63H 3/003; G09B 11/02; G09B 11/00; A63B 21/1438; B43K 23/008; A44C 9/0053
USPC ..... 446/26, 72, 327, 369; 434/162, 166; 401/8; 63/1.12
See application file for complete search history.

(56) References Cited

U.S. PATENT DOCUMENTS 1,247,183 A * 11/1917 Usterud ..... 2/163
1,797,103 A * 3/1931 Rustad ..... 401/8
2,306,317 A * 12/1942 Morrow ..... 63/7
2,501,552 A * 3/1950 Thompson ..... 401/8
2,866,440 A * 12/1958 Green ..... 434/166
4,300,307 A * 11/1981 Biasuzzi et al. ..... 446/328
4,602,885 A * 7/1986 Bischoff et al. ..... 401/6
4,944,766 A * 7/1990 Williams ..... 623/65
5,310,345 A * 5/1994 Gershon ..... 434/166
5,376,066 A * 12/1994 Phillips et al. ..... 602/21
5,542,588 A * 8/1996 Sison ..... 224/218
5,868,692 A * 2/1999 Michniewicz ..... 602/21
5,980,257 A * 11/1999 Heinz ..... 434/166
6,550,068 B1 * 4/2003 Materon ..... 2/160
6,887,212 B2 * 5/2005 Bennett ..... 602/20
6,895,639 B1 * 5/2005 Bayton ..... 16/430
7,014,379 B2 * 3/2006 Cheng et al. ..... 401/6
7,102,507 B1 * 9/2006 Lauren ..... 340/539.11
7,335,176 B2 * 2/2008 Bennett ..... 602/20
2001/0007392 A1 * 7/2001 Sugarman ..... 294/25
2005/0016210 A1 * 1/2005 Weiss et al. ..... 63/3
2005/0197610 A1 * 9/2005 Bennett ..... 602/22
2005/0232682 A1 * 10/2005 Aguirre et al. ..... 401/131
2006/0099881 A1 * 5/2006 Dodgen ..... 446/369
2007/0228092 A1 * 10/2007 Hammermeister ..... 224/218
2008/0205966 A1 * 8/2008 Harris ..... 401/7

* cited by examiner

*Primary Examiner* — Gene Kim
*Assistant Examiner* — Alyssa Hylinski
(74) *Attorney, Agent, or Firm* — Blaine T. Bettinger; George R. McGuire; Bond Schoeneck & King, PLLC

(57) ABSTRACT

A plush writing toy that is attached to the user's wrist and holds a writing utensil in its front paws, legs, or hands, thereby simulating the movements of the user as the user draws, writes, colors, or paints. The plush writing toy can be manufactured to resemble an animal or any other fictional or non-fictional child's character.

19 Claims, 5 Drawing Sheets

PLUSH WRITING TOY

CROSS-REFERENCE TO RELATED APPLICATIONS

The present application claims priority to U.S. Patent Application Ser. No. 61/171,934, filed on Apr. 23, 2009, the entirety of which is hereby incorporated by reference.

BACKGROUND OF THE INVENTION

1. Field of the Invention

The present invention relates to a plush toy used when writing and, more specifically, to a plush toy that attaches to the user's wrist and holds a pen, thereby simulating the movements of a user who is writing or drawing.

2. Description of the Related Art

It is well-known in the art to provide hand-held plush toys manufactured to resemble a bear, dog, cat, monkey or any other animal for babies, toddlers, and children. One drawback of these plush toys is the lack of any mechanism allowing the child to use or enjoy the plush toy when he or she is drawing, coloring, or writing.

BRIEF SUMMARY OF THE INVENTION

It is therefore a principal object and advantage of the present invention to provide a hand-held plush toy.

It is another object and advantage of the present invention to provide a plush toy that is carried or held by someone engaged in drawing, coloring, writing, or painting.

It is yet another object and advantage of the present invention to provide a plush writing toy that is situated on the wrist of the user and that appears to be drawing, coloring, writing, or paining along with the user.

Other objects and advantages of the present invention will in part be obvious, and in part appear hereinafter.

In accordance with the foregoing objects and advantages, the present invention provides a writing toy worn on a user's wrist. The writing toy includes: (i) a body; (ii) a first front leg adapted to reversibly hold a writing utensil; (iii) a second front leg connected to the first front leg; (iv) a first rear leg; and (v) a second rear leg connected to the first rear leg to define an opening for the user's wrist.

A second aspect of the present invention provides a writing toy with an elastic band connecting the first rear leg to the second rear leg. The elastic band allows the opening for the user's wrist, defined by the band and the rear legs, to be adjustable such that it fits a wide variety of users.

A third aspect of the present invention also provides a writing toy worn on a user's wrist. This embodiment of the writing toy includes: (i) a body; (ii) a first front leg; (iii) a second front leg; (iv) a first elastic band connecting the first front leg to the second front leg, and further containing a loop to hold the writing utensil; (v) a first rear leg; and (vi) a second rear leg, where the first and second rear legs are connected and define an opening for the user's wrist.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
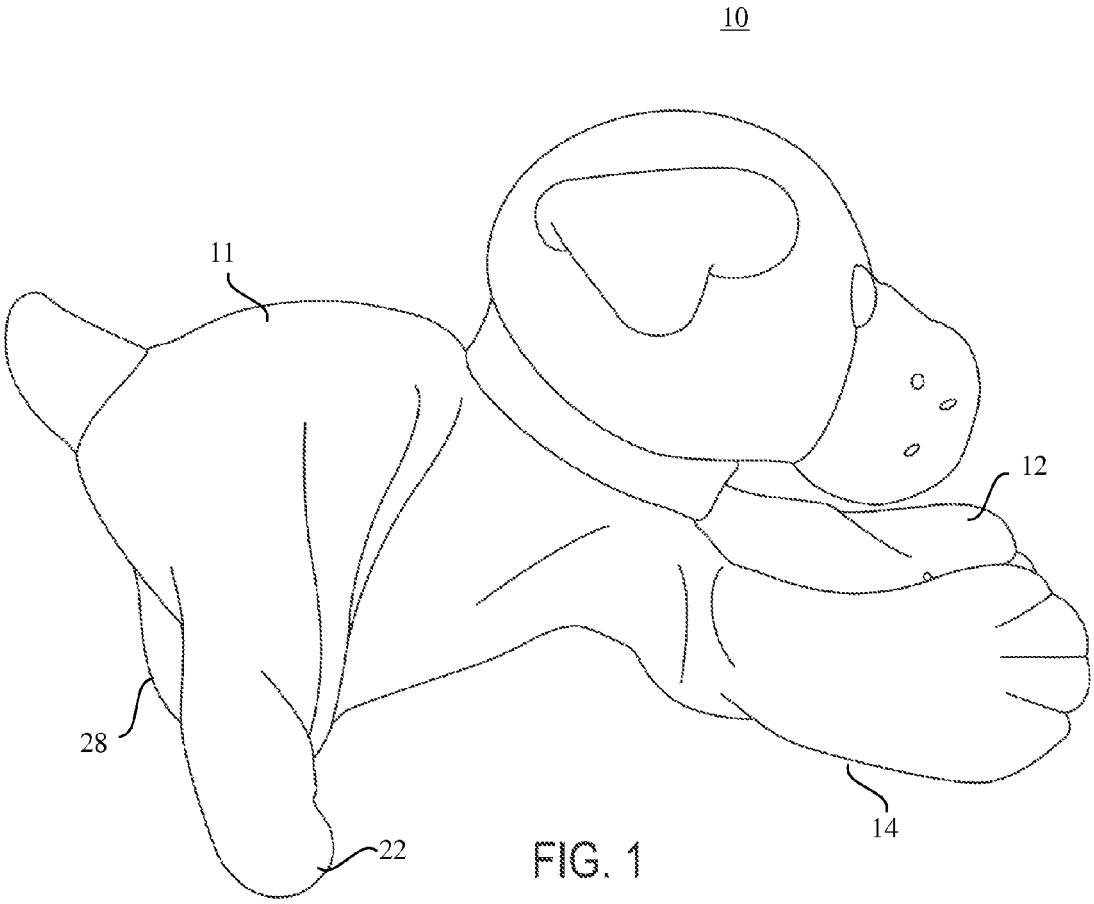
FIG. 1 is a side view of the plush writing toy according to one embodiment of the present invention.
Figure 2:
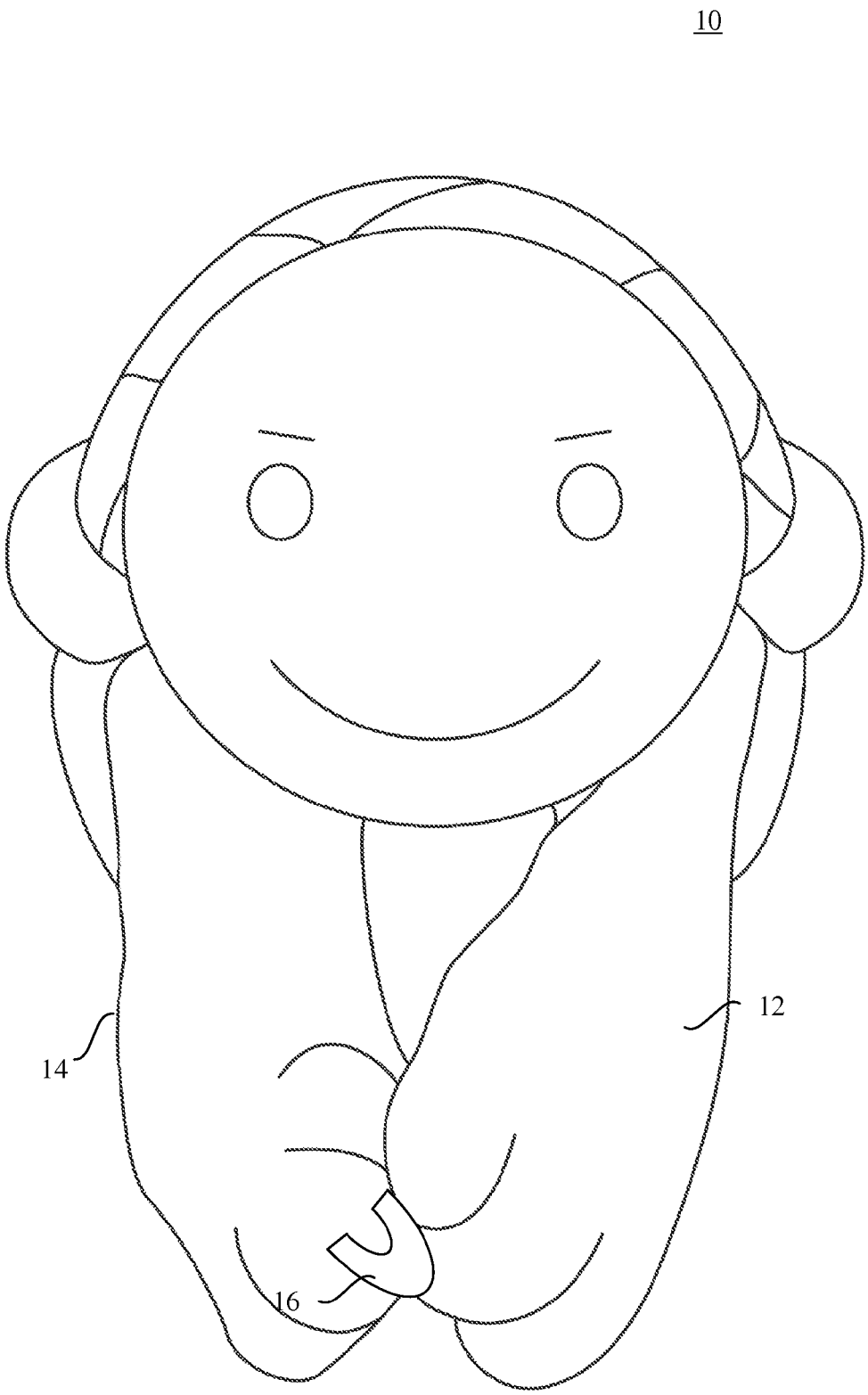
FIG. 2 is a front view of the plush writing toy according to one embodiment of the present invention.
Figure 3:
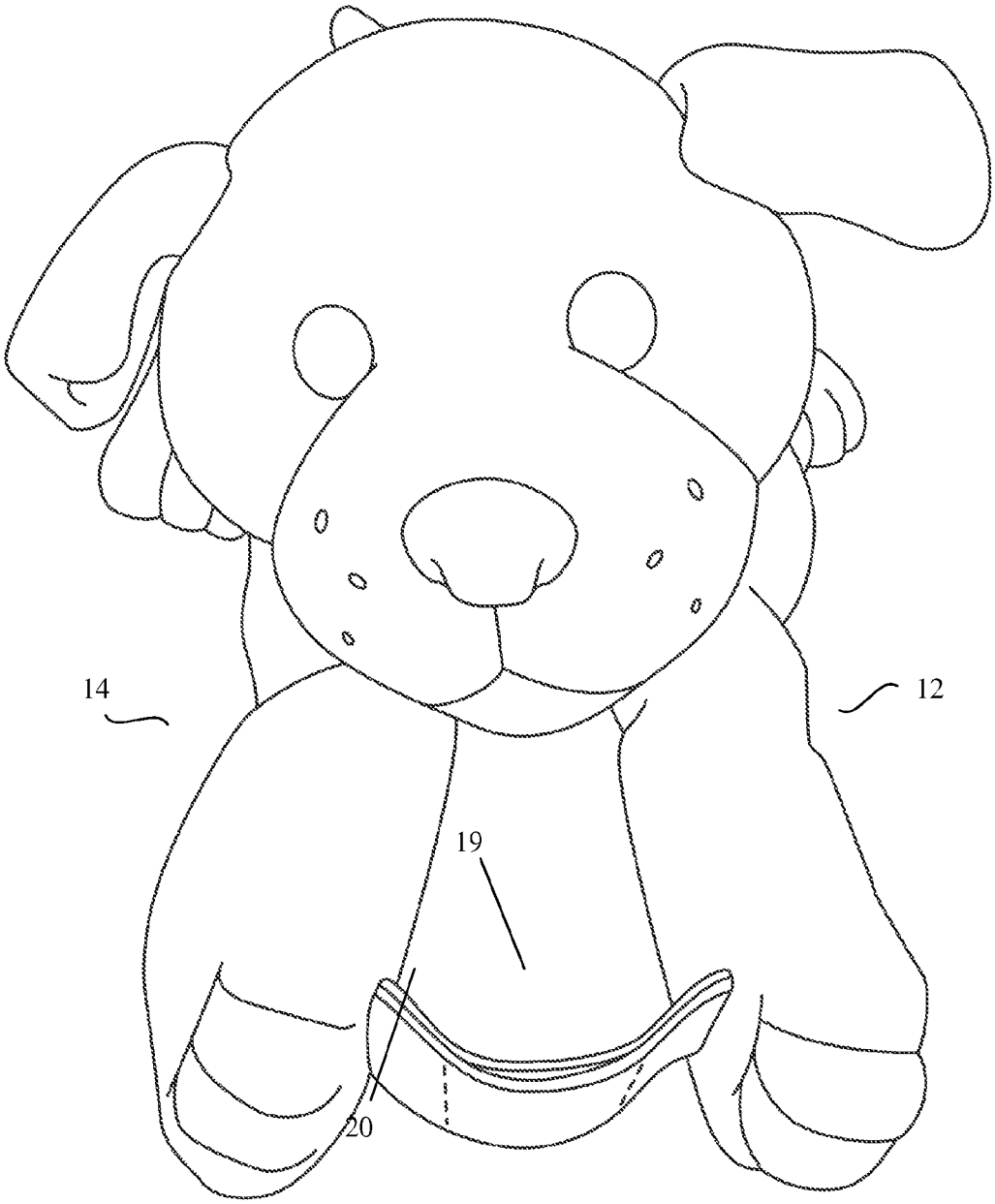
FIG. 3 is a front view of the plush writing toy according to one embodiment of the present invention.

Referring now to the drawings, wherein like reference numerals refer to like parts throughout, there is seen in FIG. 1 a front view of the plush writing toy according to one embodiment of the present invention, referred to generally by reference numeral 10. In a preferred embodiment, plush writing toy 10 comprises a body 11 and two front paws 12 and 14. Front paws 12 and 14 are preferably kept in direct communication or in very close proximity by a magnet, hook and loop, snap, button, or other known mechanism, as shown in FIG. 2. The paws can also be in reversible communication, thereby being separated when not in use but drawn together during use. One of either paw 12 or 14 also comprises a small loop of elastic material 16, approximately 1 cm in diameter, to hold a pen, pencil, marker, crayon, or other writing utensil 18. The elastic material may be comprised of any elastic material known in the art, including but not limited to, nylon, rubber, or other elastic materials. In another embodiment shown in FIG. 3, front paws 12 and 14 are joined by a short segment of an elastic band 20 which is located between the front paws or hands and is connected to the inner sides of the front paws or hands. Utensil 18 is held in a section 19 at the center of elastic band 20. Elastic band 20 may be sewn to the toy, heat-sealed, glued, or otherwise connected using any known mechanism of connection known in the art.

Figure 4:
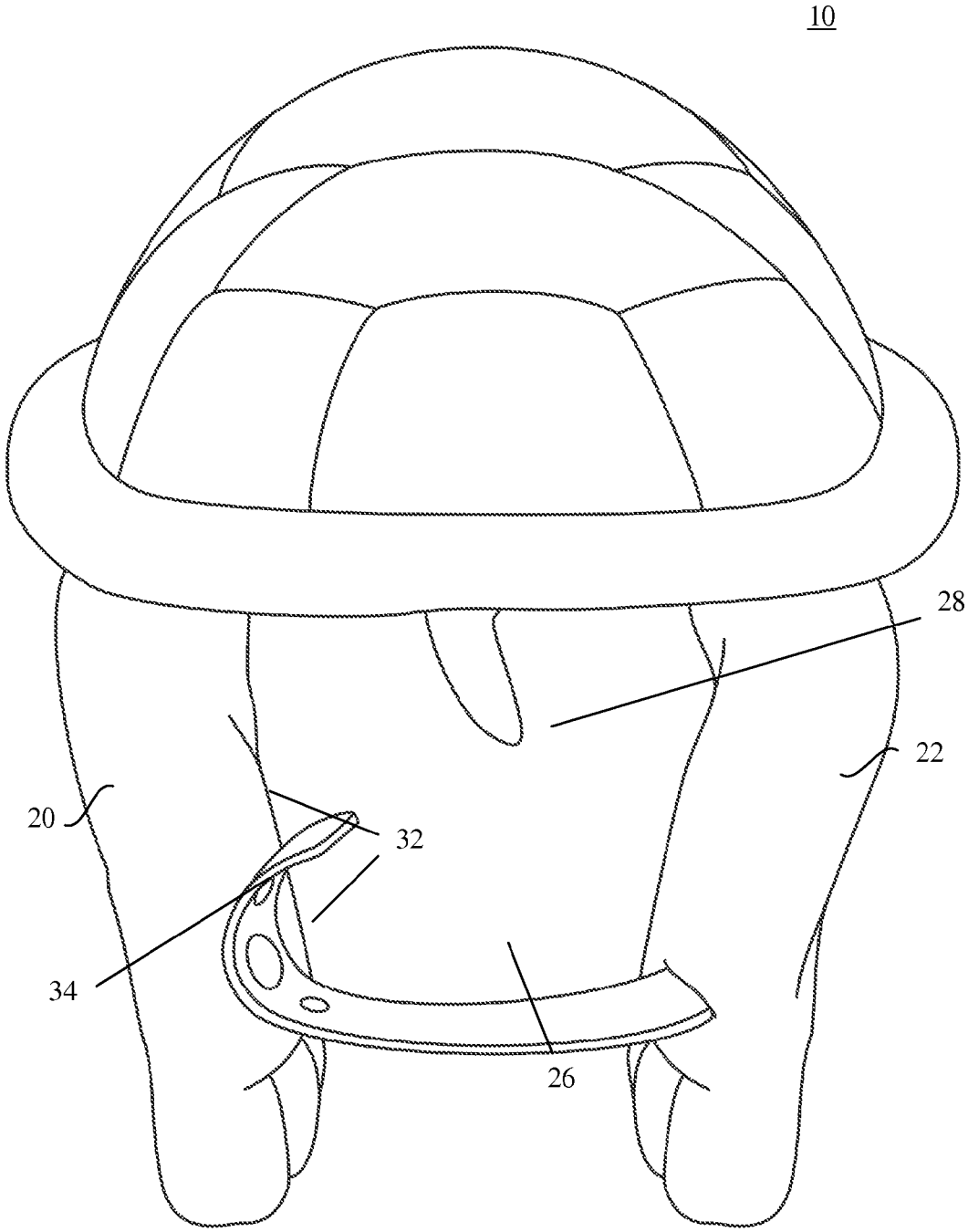
FIG. 4 is a rear view of the plush writing toy according to one embodiment of the present invention.

FIG. 4 is a reverse view of plush writing toy 10. In this embodiment, the writing toy comprises two rear legs, 20 and 22, that are joined by a short segment of an elastic band 26 which is located between the legs and is connected to the inner sides of the legs. The elastic material may be comprised of any elastic material known in the art, including but not limited to, nylon, rubber, or other elastic materials. Elastic band 26 may be sewn to the toy, heat-sealed, glued, or otherwise connected using any known mechanism of connection known in the art. In a preferred embodiment, elastic band 26 is connected to the inner-facing portions of legs 22 and 24 of plush writing toy 10, with the elastic band almost perpendicular to the two hind legs stretching across the two legs. Legs 20 and 22, together with elastic band 26, define a gap 28 big enough for a human hand to fit comfortably through.

In another embodiment, rear legs 20 and 22 are kept in direct communication or in very close proximity by a magnet, hook and loop, snap, button, or other known mechanism. The legs can also be in reversible communication, thereby being separated when not in use but drawn together when just before use. When legs 20 and 22 are in communication, they form a continuous circle or semi-circular shape that defines a gap 28 big enough for a human hand to fit comfortably through. The legs can be made of an elastic material and the circular hole can be adapted to be small enough to fit securely and snugly on a child's wrist. In this embodiment, the rear legs of plush writing toy 10 create a circular shape into which the user can place his or her hand in the direction toward the head of the toy.

To accommodate a wide variety of users, the gap formed by rear legs 20 and 22 is adjustable, as shown in FIG. 4. In this preferred embodiment, the length of elastic band 26 is variable. Elastic band 26, which is connected to one of rear leg 20 or 22, comprises button holes 32, while the other rear leg comprises a button 34 or a short elastic band with a button. The button fits into one of the button holes 32 of elastic band 26. The elastic bands can also be connected using any other mechanism of adjustable connection known in the art, including but not limited to snaps, magnets, or hook and loop. To adjust the length of the connected elastic bands, and therefore expand or reduce the size of gap 28, the button can be fit into any of the button holes of the elastic band.

Plush writing toy 10 is made of any materials safe enough and light enough to be carried on a child's wrist, including but not limited fabric, plastic, rubber, or any other material known in the art of children's toys. The toy can also be manufactured to physically represent anything that appeals to a child. In a preferred embodiment, plush writing toy 10 is a stuffed animal or character including but not limited to a rabbit, bird, bear, dog, cat, lion, tiger, turtle, monkey, elephant, giraffe, or other reptile, mammal, or dinosaur, among many other things. In addition, plush writing toy can be a representation of any character from a movie, play, book, cartoon, or other fictional or non-fictional source.

Plush writing toy 10 is designed to permit a human to write or draw with the toy while it is secured to the user's wrist and/or forearm. In one embodiment, elastic band 26 is connected between the legs of the plush toy, and the user places his or her hand between the elastic band and the posterior of the animal or figure towards the head of the animal or figure. The opening or gap 28 between rear legs 20 and 22 and the posterior is approximately the size of an average child's hand, or slightly smaller, such that the animal or figure fits snugly and securely around and atop the user's wrist. In the event the figure does not have legs (e.g. a fish or mermaid), elastic 26 may be in the shape of a circle or semi-circle and be attached below the hind end of the figure. The user would insert his or her hand into the circular or semi-circular elastic band toward the head of the figure. As an alternative to elastic band 26, the legs of the animal can be comprised of an elastic material and connected together at the feet or paws thereby creating a small opening into which the user can place his or her hand.

Figure 5:
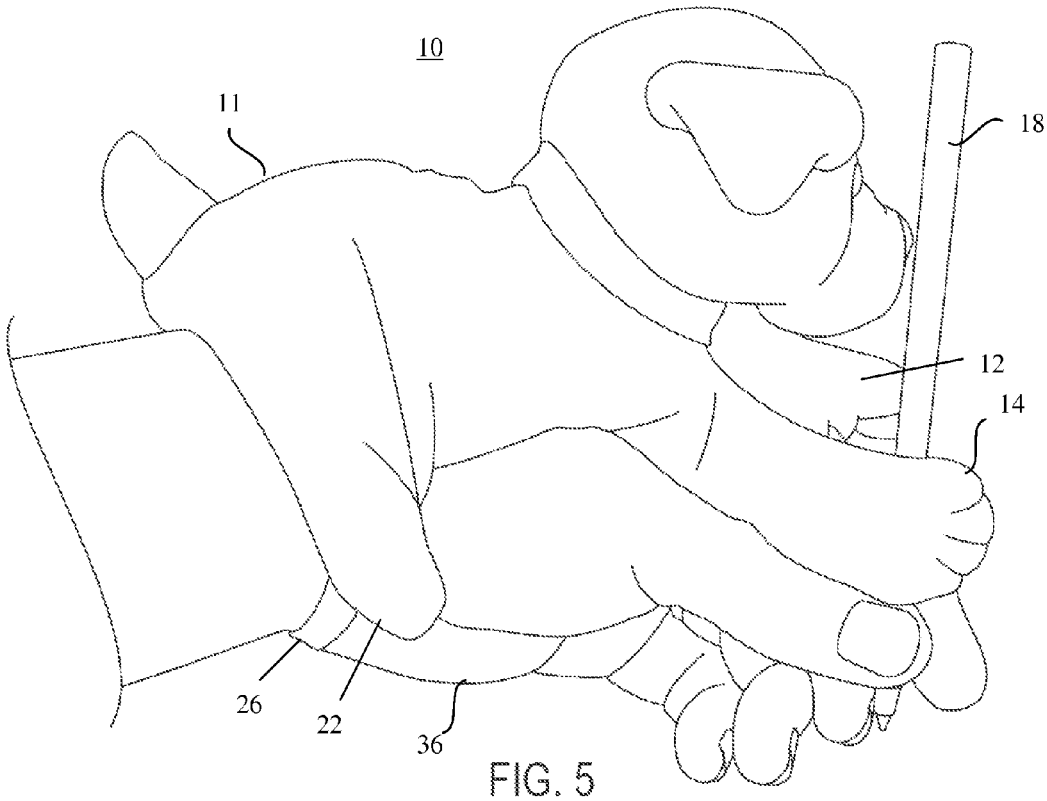
FIG. 5 is a side view of one embodiment of the present invention being worn on a user's arm with an attached writing utensil.

To install plush writing toy 10, the user first inserts his or her hand 36 into gap 28 formed by rear legs 22 and 24, or into gap 28 formed by rear legs 22 and 24 together with elastic band 26, in the direction of the front of the toy. The user then places the toy atop his or her wrist. Next, the user places writing utensil 18 in elastic band 20, or in the short loop of elastic band 16 attached to one of front paws 12 or 14. Lastly, the user grasps the writing utensil with his or her index finger and thumb and writes or draws with the writing utensil as per normal use. With plush writing toy 10 in this configuration, as shown in FIG. 5, the toy appears as if it is writing with the user, since the front paws of the toy surround the writing utensil and move along with the writing utensil as it moves during writing, drawing, or coloring.

Although the present invention has been described in connection with a preferred embodiment, it should be understood that modifications, alterations, and additions can be made to the invention without departing from the scope of the invention as defined by the claims.

What is claimed is:

1. A toy worn on a user's wrist, the toy comprising:

a body;

a first front leg, said first front leg adapted to sit on top of the first finger or thumb of the user, and further adapted to reversibly attach to a writing utensil at a location just above the user's thumb and first finger when said user is holding the writing utensil, wherein said first front leg is the only portion of the toy that attaches to the writing utensil;

a second front leg, said second front leg adapted to sit on top of the first finger or thumb of the user, wherein said first and second front legs are in communication;

a first rear leg; and a second rear leg, wherein said first and second rear legs are in reversible communication and define an opening for the user's wrist.

2. The toy of claim 1, further comprising:

a first reversible connecting means in communication with said first front leg; and a second reversible connecting means in communication with said second front leg.

3. The toy of claim 2, wherein said first and second reversible connecting means are selected from the group consisting of magnets, buttons, snaps, and hook and loop.

4. The toy of claim 1 further comprising:

an elastic band, wherein a first end of the elastic band is connected to said first rear leg, and a second end of the elastic band is connected to said second rear leg, and further wherein the elastic band, first rear leg, and second rear leg define an opening of variable size.

5. The toy of claim 1, further comprising:

connecting means connecting said first rear leg and said second rear leg, wherein said connecting means are adjustable.

6. The toy of claim 1, wherein the body of said toy is plush.

7. The toy of claim 1, wherein the body of said toy resembles an animal.

8. The toy of claim 1, wherein the body of said toy resembles a fictional character.

9. The toy of claim 1, wherein the writing utensil is a pen.

10. The toy of claim 1, wherein the writing utensil is a pencil.

11. The toy of claim 1, wherein the writing utensil is a marker.

12. The toy of claim 1, wherein the writing utensil is a crayon.

13. A toy worn on a user's wrist, the toy comprising:

a body;

a first front leg adapted to sit on top of the first finger or thumb of the user;

a second front leg adapted to sit on top of the first finger or thumb of the user;

a first elastic band, wherein a first end of the first elastic band is in communication with said first front leg, and a second end of the first elastic band is in communication with said second front leg, said first elastic band further comprising a loop to reversibly attach to a writing utensil at a location just above the user's thumb and first finger when said user is holding the writing utensil, wherein said loop is the only portion of the toy that attaches to the writing utensil;

a first rear leg; and a second rear leg, wherein said first and second rear legs are in communication and define an opening for the user's wrist.

14. The toy of claim 13, further comprising;

a second elastic band, wherein a first end of said second elastic band is connected to said first rear leg, and a second end of said second elastic band is connected to said second rear leg, and further wherein said second elastic band, first rear leg, and second rear leg define an opening of variable size.

15. The toy of claim 13, further comprising:

connecting means connecting said first rear leg and said second rear leg, wherein said connecting means are adjustable.

16. The toy of claim 13, wherein the body of said toy is plush.

17. The toy of claim 13, wherein the body of said toy resembles an animal.

18. The toy of claim 13, wherein the body of said toy resembles a fictional character.

19. A toy worn on a user's wrist, the toy comprising:

a body;

a first front leg adapted to sit on top of the first finger or thumb of the user;

a second front leg adapted to sit on top of the first finger or thumb of the user;

a first elastic band, wherein a first end of the first elastic band is in communication with said first front leg, and a second end of the first elastic band is in communication with said second front leg, said first elastic band further comprising a loop to reversibly attach to a writing utensil at a location just above the user's thumb and first finger when said user is holding the writing utensil, wherein said loop is the only portion of the toy that attaches to the writing utensil; and a second elastic band, wherein the second elastic band is attached at both ends to said body and defines an opening for the user's wrist.

* * * * *